US006321426B1

(12) United States Patent
Ahrweiler

(10) Patent No.: US 6,321,426 B1
(45) Date of Patent: Nov. 27, 2001

(54) DEVICE FOR APPLYING A TREATMENT MEDIUM TO A MOVING STRIP OF MATERIAL

(75) Inventor: Karl-Heinz Ahrweiler, Willich (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 09/700,067

(22) PCT Filed: Mar. 27, 1999

(86) PCT No.: PCT/EP99/02116

§ 371 Date: Feb. 26, 2001

§ 102(e) Date: Feb. 26, 2001

(87) PCT Pub. No.: WO99/60195

PCT Pub. Date: Nov. 25, 1999

(30) Foreign Application Priority Data

May 18, 1998 (DE) ..... 298 08 981 U

(51) Int. Cl.[7] ..... D06B 1/00

(52) U.S. Cl. ..... 28/167; 68/200

(58) Field of Search ..... 28/167, 165, 104, 28/105; 68/200, 205 R, 202, 62, 96, 21, 44, 45, 242; 118/500, 410, 419

(56) References Cited

U.S. PATENT DOCUMENTS

| | | | | |
|---|---|---|---|---|
| 3,340,140 | * | 9/1967 | Heys | 162/358 |
| 3,587,458 | * | 6/1971 | Feier | 101/114 |
| 3,854,441 | * | 12/1974 | Park | 118/410 |
| 4,497,249 | * | 2/1985 | Mitter | 101/120 |
| 4,576,112 | * | 3/1986 | Funger et al. | 68/200 |
| 4,872,325 | * | 10/1989 | Moser et al. | 68/200 |
| 5,063,646 | | 11/1991 | Zeiffer et al. | 28/167 |
| 5,195,225 | * | 3/1993 | Zeiffer et al. | 28/167 |
| 5,366,161 | * | 11/1994 | Potter et al. | 68/200 |
| 5,737,789 | | 4/1998 | Fleissner | 8/151 |
| 5,737,945 | * | 4/1998 | Fleissner | 68/200 |

FOREIGN PATENT DOCUMENTS

| | | |
|---|---|---|
| 30 30 233 | 2/1982 | (DE) . |
| 33 15 770 | 10/1984 | (DE) . |
| 38 39 100 | 5/1990 | (DE) . |
| 196 04 934 | 1/1997 | (DE) . |
| 2 174 929 | 11/1986 | (GB) . |

* cited by examiner

*Primary Examiner*—Amy B. Vanatta
(74) *Attorney, Agent, or Firm*—Kenyon & Kenyon

(57) ABSTRACT

The device (100) is used to apply a treatment medium to a moving strip of material (W) e.g. a dyebath to a strip of carpet. The device (100) is composed of a rigid support (3) that is securely arranged in a machine frame (1) and extends in a perpendicular position with respect to the strip of material, an inflatable pressure cushion (12) extending along the support (3), a less rigid supporting beam (13) arranged on the pressure cushion (12) with ends that are mounted in an articulating manner on the machine frame (1) around axes (22, 22) that are parallel to the strip of material, in addition to an application beam (25) placed on the supporting beam (13) in perpendicular position with respect to the strip of material (W) and running parallel to the surfaces thereof, whereby the application beam rests upon the strip of material (W) with the aid of a sliding surface. An application slit (30) that opens out onto the sliding surface (35) in placed in the vicinity thereof. Feed pipes for the treatment medium are arranged along the length of the application slit (30) and lead thereto. A support roller (10), running parallel to the application slot (30) and located opposite thereto, and a device that engages with the support roller (10) to adjust the gap (40) between the support roller (10) and the application beam (25) are provided on the other side of the strip of material (W).

4 Claims, 3 Drawing Sheets

DEVICE FOR APPLYING A TREATMENT MEDIUM TO A MOVING STRIP OF MATERIAL

BACKGROUND OF THE INVENTION

A device for applying a treatment medium to a moving strip of material is known from German Patent 33 15 770 C2. In that device, an application beam extends perpendicular over a strip of carpet that forms a strip of material and is curved forward relative to it. The beam contains an application slit that opens towards the strip of material. A treatment medium, dye bath in the exemplary embodiment, is passed to the application slit by a plurality of feed pipes at locations distributed over the width of the strip of material. Below the strip of carpet, an elastic pillow, for example an inflatable pillow, is provided. The elastic pillow presses the strip of material against the application beam on both sides of the application slit. An equilibrium situation results via the force. In other words, it is not possible to set a pre-determined gap between the application beam and the contact pressure element. In particular, it is difficult, in view of the great width of strips of carpet (about 5 m), to keep the conditions uniform over the width of the gap.

This problem also exists in the device shown in U.S. Pat. No. 5,063,646. In that device, a strip of carpet, with the nap down, is passed over a housing supported in a machine frame. A feed pipe that extends across the width of the strip of material is arranged in the housing. The top of the feed pipe is aligned with the top of the housing. The housing supports the strip of carpet on both sides of the feed pipe, over a short distance. At the peak of the feed pipe, there are many small perforations, through which the dye bath penetrates from the feed pipe into the nap of the carpet. A roller that runs along with the strip of material, provides support on the back of the side opposite the exit region of the dye bath. The roller is mounted in pivot levers affixed at the rollers' ends, and can be adjusted relative to the exit region by pivoting these levers. The bearing blocks of the pivot levers are vertically adjustable in order to determine the gap width between the support roller and the exit region. Given the large width of the strip of carpet, uniformity of the situation in the gap over the entire width is difficult to achieve.

SUMMARY OF THE INVENTION

The present invention is based on the objective of creating an application device in which the application conditions can be made as constant as possible over the width of the strip of material.

In accordance with this objective, a device for applying a treatment medium to a moving strip of material has a rigid support that is securely arranged in a machine frame. The rigid support extends in a perpendicular position with respect to the strip of material. An inflatable pressure cushion extends on the rigid support. A less rigid supporting beam is arranged on the pressure cushion. The ends of the less rigid supporting beam are mounted in an articulating manner on the machine frame around axes that are parallel to the strip of material. An application beam is placed on the supporting beam in a perpendicular position with respect to the strip of material and running parallel to the surface thereof. The application beam rests upon the strip of material with the aid of a sliding surface. The application beam has an application slit that opens out in the region of the sliding surface onto the surface. Feed pipes for the treatment medium are arranged along the length of the application slit, and the feed pipes are in fluid communication with the application slit. A support roller runs parallel to the application slit and is located opposite the application slit on the other side of the strip of material. A device engages with the support roller for adjusting the gap between the support roller and the application beam.

The rigid support is so resistant to bending that it does not bend to any noticeable degree under the line load that occurs between the support roller and the application beam. The supporting beam, on the other hand, which is supported on the rigid support via the inflatable pressure cushion, is supposed to demonstrate a lower bending resistance, so that it can bend slightly under the forces that occur, for example in order to be able to adapt itself to any bending of the support roller that occurs under the uniform stress of the pressure cushion.

Using the device, the gap can be adjusted to a specific value and opened to draw in the strip of material. To close the gap, the piston/cylinder units are moved to a stop, with a defined gap remaining between the support roller and the application beam, through which the strip of material passes. In other words, the support roller is not moved to rest against the application beam until an equilibrium of force occurs.

A beam along which the strip of material passes, and which is supported on a rigid support via an inflatable pressure cushion, and is pressed against the strip of material by a roller that runs along with the strip of material, is actually known from German Patent 30 30 233 A1. However, this known beam is not an application beam, but rather merely a beam that forms an extended nip in a wet press for removing water from strips of fiber material.

In the present invention, the support roller can be arranged similar to U.S. Pat. No. 5,063,646, on two pivot levers arranged at its two ends, which can pivot around a crosswise axis, and can be moved to open the gap, using piston/cylinder units.

In the preferred embodiment of the invention, the closed ends of the piston/cylinder units are supported on the machine frame via a self-inhibiting mechanical lengthwise drive.

The advance of these drives determines the gap width at the support roller. Spindle drives or taper drives, in particular, are possible drives that can be used as self-inhibiting mechanical lengthwise drives.

An important further development is that the mechanical lengthwise drives can be separately controlled to adjust the gap in width perpendicular to the strip of material.

In this way, the gap can be changed in many different ways. It can, of course, be set to be uniform over the width, but it can also be made narrower on the right side or the left side, for example. In combination with the slight bending of the supporting beam that carries the application beam, this results in the ability to control the application conditions in the gap, in such a way that the strip of material is uniformly treated with treatment medium over its entire width.

The drawings shows an exemplary embodiment of the invention, in schematic form.

DETAILED DESCRIPTION OF THE INVENTION

Figure 1:
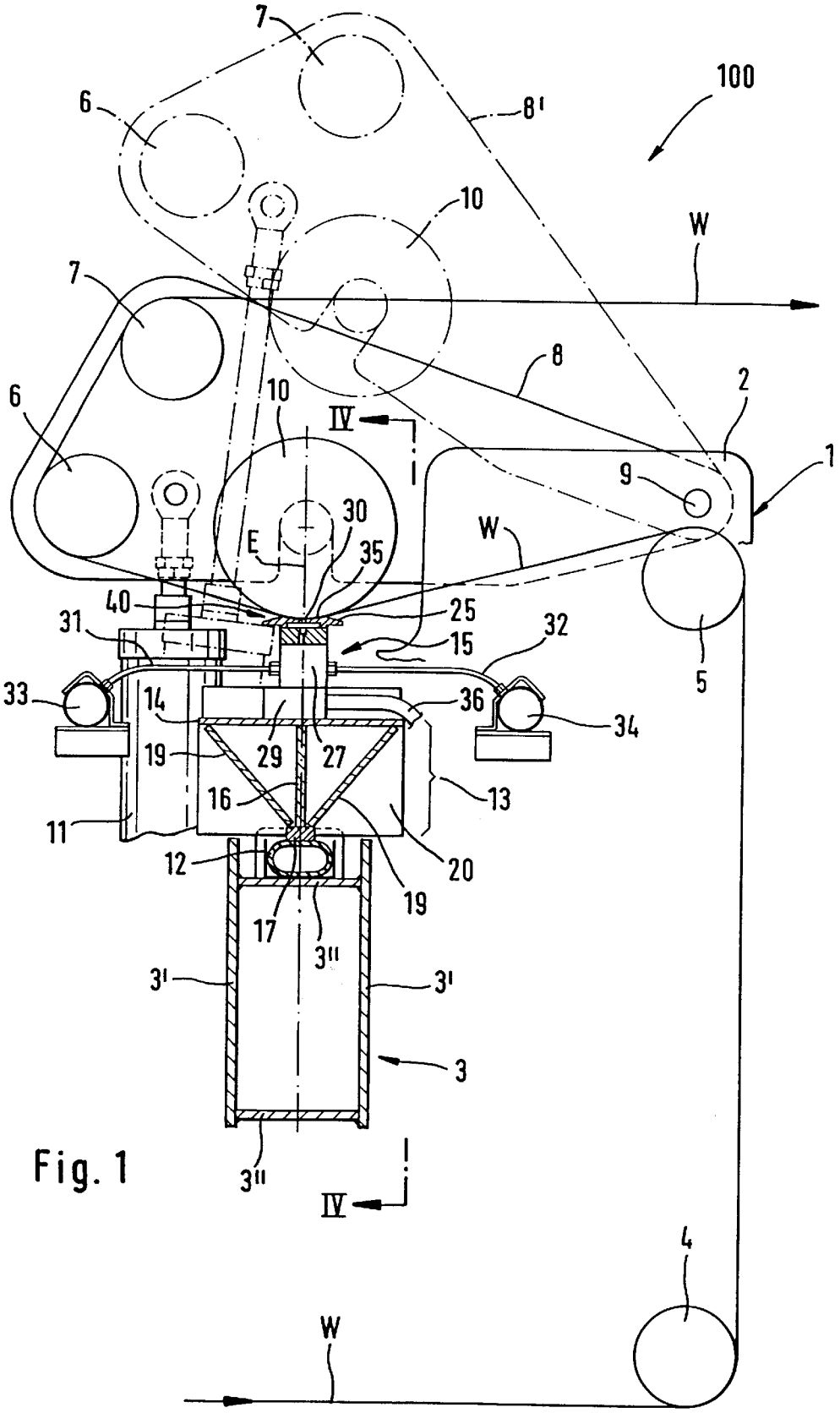
FIG. 1 shows a side view of the device.

The device, designated as a whole as 100 in FIG. 1, includes a machine frame 1, which is only indicated with its outline. The machine frame 1 has two plate-shaped cheeks 2 that stand opposite one another on both sides of a strip of material W, and are connected with one another by a very rigid support 3 that extends perpendicular to them. The rigid support 3 is structured as a box support with a rectangular cross-section, with longer sides 3' that stand vertically and are connected with one another by horizontal sides 3".

The strip of material W runs approximately horizontally in the bottom region of the device, towards a deflection roller 4 that is mounted on the edge of the cheeks 2, 2, on the right according to FIG. 1. The strip of material W is deflected upward by 90° there, and passes a deflection roller 5 arranged in the top region of the cheeks, above the deflection roller 4. The top peak of the roller 5 lies approximately at the same level as the bottom peak of the next deflection roller 6, which is located at the left edge of the device 100. The strip of material W passes between the deflection rollers 5, 6 in a shallow dip, at the lowest point of which it rests against the bottom of a support roller 10. Above the deflection roller 6, another deflection roller 7 is provided, which deflects the strip of material W in such a way that it can pass out of the device 100 as shown in FIG. 1, approximately horizontally to the right.

The deflection rollers 6 and 7 as well as the support roller 10 are mounted on lateral pivot levers 8, which are arranged to pivot up and down on the outside of the cheeks 2, 2, at their right end in FIG. 1, in a pivot bearing 9 provided above the deflection roller 5.

Figure 2:
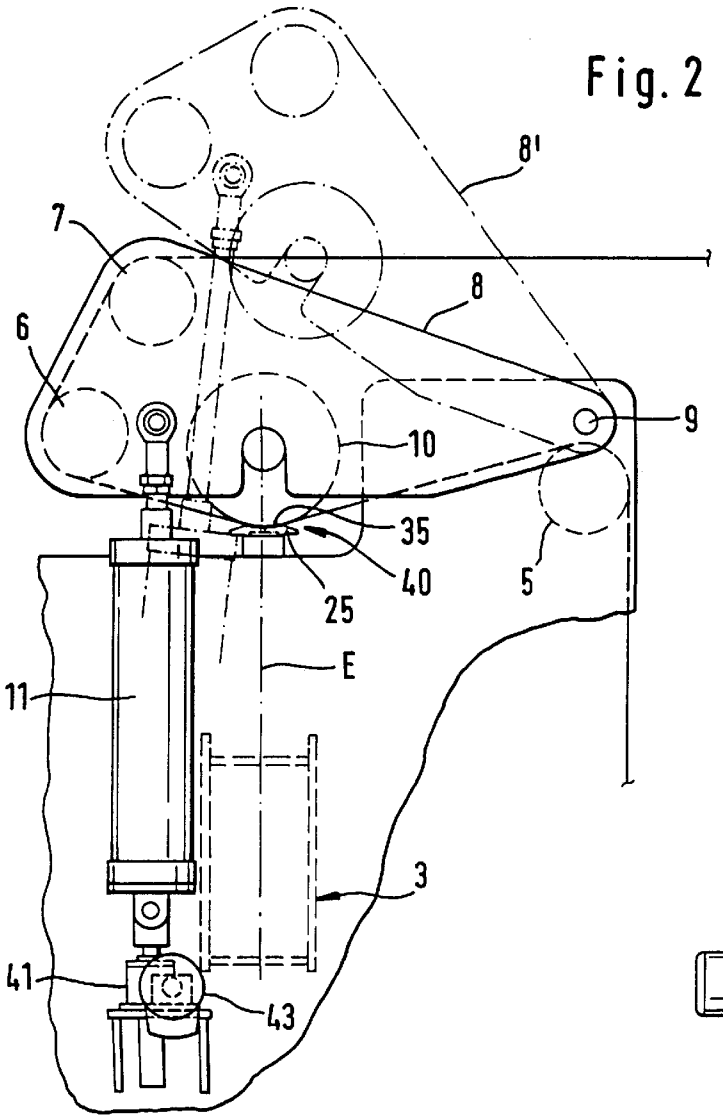
FIG. 2 shows a partial view corresponding to FIG. 1, in which only the elements for adjusting the support roller are shown.

Pivoting the pivot levers 8 up and down along with the deflection rollers 6, 7 and the support roller 10 is accomplished by piston/cylinder units 11 assigned to each pivot lever 8, 8. The piston/cylinder units are mounted at the bottom end of the machine frame 1. The mounting is described in connection with FIGS. 2 and 3. The piston/cylinder units 11 can be moved from a position shown entirely moved into a stop, to a position in which they are entirely moved out, shown with dot-dash lines in FIG. 1, in which the pivot levers 8, 8 together with the deflection rollers 6, 7 and the support roller 10 are raised, in order to be able to thread the strip of material W into the device 100 and, if necessary, to perform cleaning work in the device 100.

Figure 4:
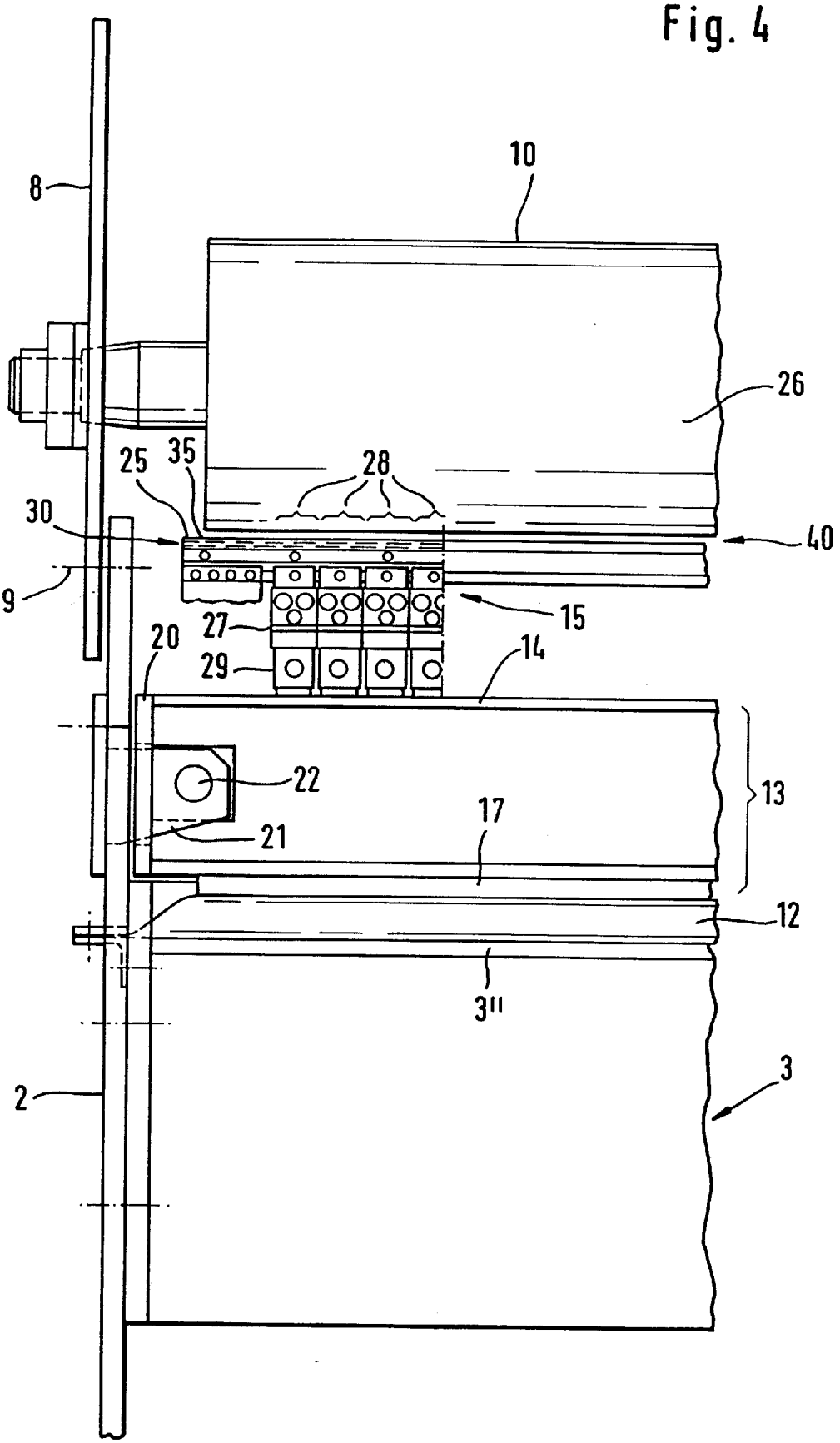
FIG. 4 shows a view of the region of the application beam, approximately along line IV—IV in FIG. 1.

An inflatable pressure cushion 12 that extends over the width of the strip of material and therefore almost over the length of the rigid support 3 is arranged on the top horizontal side 3" of the rigid support 3, with a supporting beam, indicated as a whole as 13, arranged on top of it. The bending resistance of the supporting beam 13, in the plane of effect E, perpendicular to the strip of material W, through the rigid support 3 and the support roller 10, is less than that of the rigid support 3. The construction of the supporting beam 13 can vary. In the exemplary embodiment, the supporting beam 13 includes a top horizontal plate 14 for installation of the application arrangement, indicated as a whole as 15, which will still be described, and a bridge plate 16 that extends below the top plate 14, in the plane of effect E, which rests on the pressure cushion 12 with a foot 17 that extends along its bottom edge. The arrangement is stabilized by slanted stays 19 that run at a slant from the edges of the top plate 14 to the foot. At the ends of the supporting beam 13, head plates 20 (FIG. 4) are provided, which extend to just in front of the cheeks 2, 2, but are not welded to them. Rather, bearing blocks 21 are provided on the cheeks 2, 2, pointing inward, with the ends of the supporting beam 13 being mounted in articulated manner around a pivot axis 22 that is located close to the cheeks 2, 2. The pivot axis extends parallel to the direction of movement of the strip of material W, i.e. perpendicular to the plane of effect E. The supporting beam 13 can therefore bend under the forces that act on it, without compression occurring at the cheeks 2, 2.

The application arrangement, indicated as a whole as 15, includes the actual application beam 25, which contains an application slit 30. The application slit 30 lies in the plane of effect E, directly below the support roller 10. The top of the application beam 25 forms a surface on which strip of material W slides. The application beam 25 is convex with a radius that corresponds to the support roller 10, and therefore lies closely against the support roller 10, forming a cylindrically curved gap 40 over a short distance in front of and behind the application slit 30, seen in the direction of movement of the strip of material W. Therefore, when the strip of material W runs through the gap 40, the application slit 30 is more or less sealed parallel to the direction of movement. The application slit 30 is charged by a plurality of application valves 27 arranged over the width of the strip of material W, directly adjacent to one another, each of them having a width (in the crosswise direction of strip of material W) of 15 or 50 mm, for example, and giving off the treatment medium that they allow to pass through into a correspondingly wide segment 28 of the directly adjacent application slit 30 in the application beam 25. The valves 27 each have a rotating valve body, not shown, on the inside; its pneumatic drive is indicated as 29 in FIG. 4. The individual valves 27 are built up on related drives 29, which in turn are mounted on the top plate 14 of the supporting beam 13.

The valves 27 each have two connections that are connected with feed pipes 33, 34 for two treatment media, e.g. two dye baths, via lines 31, 32. The valves 27 furthermore have three positions, namely to allow one or the other treatment medium to pass through, and for "closed." By activating the valves 27 accordingly, application of two treatment media in the form of a pattern, or uniform application, takes place on the strip of material W. The air pipes that serve to activate the drives 29, i.e. the valves 27, are indicated as 36 (FIG. 1).

Figure 3:
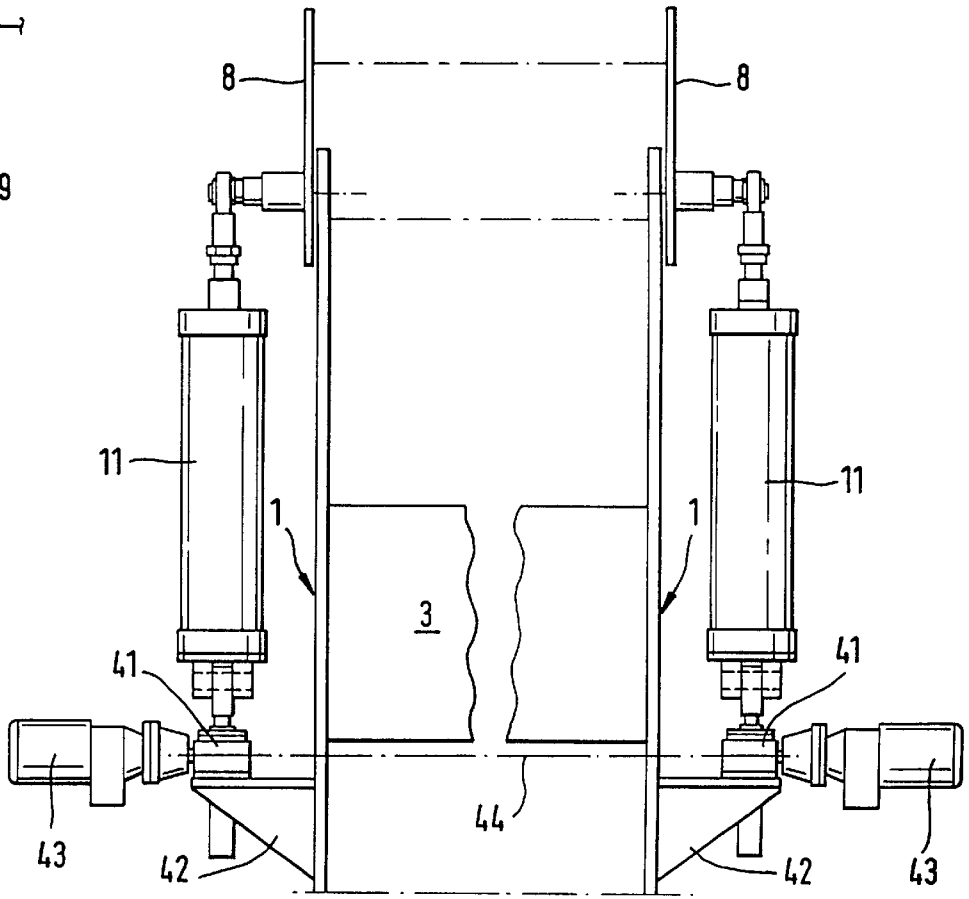
FIG. 3 shows a view in accordance with FIG. 2, from the left.

If the piston/cylinder units 11, 11 that are located on both sides are moved in all the way to the stop, a uniform gap 40 between the support roller 10 and the application beam 34 is obtained over the width of the strip of: material W. This gap 40, which is maintained even without any strip of material W, can be set to a corresponding width to adjust it to a certain type and thickness of the strip of material. This width corresponds to the fully moved in position of the piston/cylinder units 11, 11. For this purpose, the piston/cylinder units 11 are each supported on a self-inhibiting spindle drive 41 on a console 42 that is rigidly attached to the machine frame 1. The advancing direction of the spindle drives 41 essentially corresponds to that of the piston/cylinder units 11, 11. The drive motor for each spindle nut is indicated as 43. As long as the drive motors 43, 43 on both sides are activated uniformly, the gap 40 becomes uniformly wider or narrower over the entire width. However, if one of the drive motors runs for a longer or shorter time than the other, the corresponding spindle drive 41 is adjusted more than the other, and the gap becomes uneven over the width of the strip of material W, i.e. it is set at a slant. This can be desirable in order to be able to adjust the application of treatment medium over the width of the strip of material W, in interaction with the bending of the support roller 10 and the supporting beam 13. For example, it is desirable if the strip of material W is unevenly moist as it enters the device 100, or if the density of its tufting is uneven. If driven separately, the two spindle drives 41, 41 can therefore set the support roller 10 at a slight slant. If this possibility is not desired, a single drive 43 can also be sufficient, if a connecting shaft 44, only indicated schematically in FIG. 3, is provided.

With the arrangement as described, the support roller 10 is brought into a mechanically, i.e. geometrically unambiguous position relative to the fixed application beam 25. The position is determined by the stop position of the piston/cylinder units 11, 11 and the advancing position, in each instance, of the spindle drives 41, 41. In this way, the gap 40 can be calibrated independent of force.

What is claimed is:

1. A device for applying a treatment medium to a moving strip of material comprising:

a rigid support that is securely arranged in a machine frame and extends in a perpendicular position with respect to the strip of material;

an inflatable pressure cushion extending on the rigid support;

a less rigid supporting beam arranged on the pressure cushion with ends that are mounted in an articulating manner on the machine frame around axes that are parallel to the strip of material;

an application beam placed on the supporting beam in a perpendicular position with respect to the strip of material and running parallel to the surface thereof, where the application beam rests upon the strip of material with the aid of a sliding surface, the application beam having an application slit that opens out in the region of the sliding surface onto the surface, feed pipes for the treatment medium arranged along the length of the application slit, said feed pipes in fluid communication with the application slit;

a support roller running parallel to the application slit and located opposite the application slit on the other side of the strip of material; and a device engaging with the support roller for adjusting the gap between the support roller and the application beam.

2. A device according to claim 1, wherein the support roller is mounted on two pivot levers arranged at the rollers two ends, which can pivot around a crosswise axis and can be moved to open the gap using piston/cylinder units.

3. The device according to claim 2, wherein the piston/cylinder units have closed ends and the closed ends of the piston/cylinder units are supported on the machine frame by a self-inhibiting mechanical lengthwise drives.

4. The device according to claim 3, wherein the self-inhibiting mechanical lengthwise drives can be separately controlled to adjust the gap in width perpendicular to the strip of material.

* * * * *